US011176872B2

(12) United States Patent
Jeong et al.

(10) Patent No.: US 11,176,872 B2
(45) Date of Patent: Nov. 16, 2021

(54) DISPLAY APPARATUS AND CONTROLLING METHOD THEREOF

(71) Applicant: SAMSUNG ELECTRONICS CO., LTD., Suwon-si (KR)

(72) Inventors: Hyun Tai Jeong, Suwon-si (KR); Kwang Min Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/772,009

(22) PCT Filed: Dec. 3, 2018

(86) PCT No.: PCT/KR2018/015208
§ 371 (c)(1),
(2) Date: Jun. 11, 2020

(87) PCT Pub. No.: WO2019/117522
PCT Pub. Date: Jun. 20, 2019

(65) Prior Publication Data

US 2021/0090488 A1 Mar. 25, 2021

(30) Foreign Application Priority Data

Dec. 11, 2017 (KR) ..... 10-2017-0169372

(51) Int. Cl.
*G09G 3/32* (2016.01)

(52) U.S. Cl.
CPC ..... *G09G 3/32* (2013.01); *G09G 2300/026* (2013.01); *G09G 2320/0686* (2013.01); *G09G 2360/16* (2013.01); *G09G 2370/00* (2013.01)

(58) Field of Classification Search
None
See application file for complete search history.

(56) References Cited

U.S. PATENT DOCUMENTS 10,009,657 B2 6/2018 Kim et al.
2016/0098963 A1 4/2016 Kim et al.
(Continued)

FOREIGN PATENT DOCUMENTS

KR 10-2012-0075805 A 7/2012
KR 10-2016-0084655 A 7/2016
(Continued)

OTHER PUBLICATIONS

International Search Report (PCT/ISA/210) dated Apr. 2, 2019 by the International Searching Authority in counterpart International Application No. PCT/KR2018/015208.
(Continued)

*Primary Examiner* — Aneeta Yodichkas
(74) *Attorney, Agent, or Firm* — Sughrue Mion, PLLC

(57) ABSTRACT

Provided are a display apparatus and a controlling method thereof for implementing a local dimming function. A display apparatus including a plurality of display modules includes: a receiver configured to receive image data; a controller configured to calculate a local dimming value based on the received image data, and extract the image data corresponding to the display module from the image data to which the local dimming value is applied; and an output configured to output the extracted image data to be displayed.

11 Claims, 9 Drawing Sheets

(56) References Cited

U.S. PATENT DOCUMENTS

| | | | | |
|---|---|---|---|---|
| 2016/0132282 | A1* | 5/2016 | Choi | G09G 3/003 345/1.3 |
| 2016/0231976 | A1* | 8/2016 | Ryu | G06F 3/1446 |
| 2016/0358582 | A1* | 12/2016 | Lee | G06F 3/1446 |
| 2017/0115946 | A1 | 4/2017 | Kim et al. | |

FOREIGN PATENT DOCUMENTS

| | | | |
|---|---|---|---|
| KR | 10-2016-0097599 | A | 8/2016 |
| KR | 10-2017-0046989 | A | 5/2017 |
| KR | 10-2017-0117758 | A | 10/2017 |

OTHER PUBLICATIONS

Written Opinion (PCT/ISA/237) dated Apr. 2, 2019 by the International Searching Authority in counterpart International Application No. PCT/KR2018/015208.

* cited by examiner

DISPLAY APPARATUS AND CONTROLLING METHOD THEREOF

TECHNICAL FIELD

Embodiments of the disclosure relate to a display apparatus and a controlling method thereof, more specifically to an LED display apparatus and a controlling method for implementing a function for local dimming function.

BACKGROUND ART

LED display apparatuses using light emitting diodes (LEDs) have excellent brightness and color characteristics compared to other types of display devices (for example, LCD types), and thus are often used as indoor/outdoor billboards, indoor/outdoor information boards, billboards in stadiums, or as indoor/outdoor wallpaper (backdrop). In addition, it is easy to expand their size by arranging them in a matrix form of M×N (where M and N are natural numbers) using a light emitting element.

As the demand for indoor and outdoor large-sized LED display devices implemented in the form of the M×N matrix increases, the need to provide a smoother screen to consumers through the LED display devices is increasing.

DISCLOSURE

Technical Problem

In one aspect, when a display apparatus receives image data from a source device, each display module of the display apparatus composed of a plurality of the display modules, determines a local dimming value for a dimming area based on the entirety of image data, and extracts and displays the image data corresponding to the display module.

Technical Solution

In accordance with an aspect of the disclosure, in a display apparatus including a plurality of display modules, each of the plurality of display modules may include: a receiver configured to receive image data; a controller configured to calculate a local dimming value based on the received image data, and extract the image data corresponding to the display module from the image data to which the local dimming value is applied; and an output configured to output the extracted image data to be displayed.

Also, the each of the plurality of display modules may further comprise a transmitter configured to transmit the received image data from the receiver to another display module connected to the plurality of display module.

Also, the transmitter may transmit the identical image data with the received image data from the receiver to the other display module connected to the plurality of display module.

Also, the controller may determine a dimming area based on the received image data and calculates a local dimming value of the dimming area.

Also, the controller may calculate a luminance average value for each block of the received image data, and determines a dimming area based on the luminance average value.

Also, the controller may calculate the local dimming value to output a brightness of the dimming area having a luminance value equal to or higher than a preset reference value more brightly than the luminance average value, and may calculate the local dimming value to output a brightness of the dimming area having a luminance value below the preset reference value less brightly than the luminance average value.

Also, the display apparatus may further include: a memory in which device setting information for extracting the image data corresponding to the display module is stored.

Also, the plurality of display modules may include a first LED module provided to receive image data from a source device; and a second LED module provided to receive the same image data as the received image data from the first LED module.

Also, the first LED module may display the image data corresponding to the first LED module among the image data to which the local dimming value is applied, and the second LED module may display the image data corresponding to the second LED module among the image data to which the local dimming value is applied.

In accordance with an aspect of the disclosure, a control method of a display apparatus including a plurality of display modules may comprise: receiving image data from the display module; calculating a local dimming value based on the received image data; and extracting and displaying the image data corresponding to the image data corresponding to the display module from the image data to which the local dimming value is applied.

The method may further comprise transmitting the received image data from the display module to another display module connected to the plurality of display module.

The method may further comprise transmitting the received image data from the display module to the other display module connected to the plurality of display module.

The calculating the local dimming value based on the received image data may include determining a local dimming area based on the received image data; and calculating the local dimming value for the local dimming area.

The calculating the local dimming value based on the received image data may include calculating a luminance average value for each block of the received image data, and determining a dimming area based on the luminance average value.

The calculating the local dimming value based on the received image data may include: calculating the local dimming value to output a brightness of the dimming area having a luminance value equal to or higher than a preset reference value more brightly than the luminance average value, and calculating the local dimming value to output a brightness of the dimming area having a luminance value below the preset reference value more brightly than the luminance average value.

The plurality of display modules may include: a first LED module provided to receive image data from a source device; and a second LED module provided to receive the same image data as the received image data from the first LED module.

The first LED module may display the image data corresponding to the first LED module among the image data to which the local dimming value is applied, and the second LED module may display the image data corresponding to the second LED module among the image data to which the local dimming value is applied.

Advantageous Effects

According to a display apparatus and a control method thereof, it is possible to provide a smoother screen to a user by allowing a local dimming function to be implemented in a display device composed of a plurality of LED modules.

In more detail, it is possible to output a screen naturally as if viewing a single screen even when outputting multiple screens through the plurality of LED modules.

MODE FOR INVENTION

Figure 1:
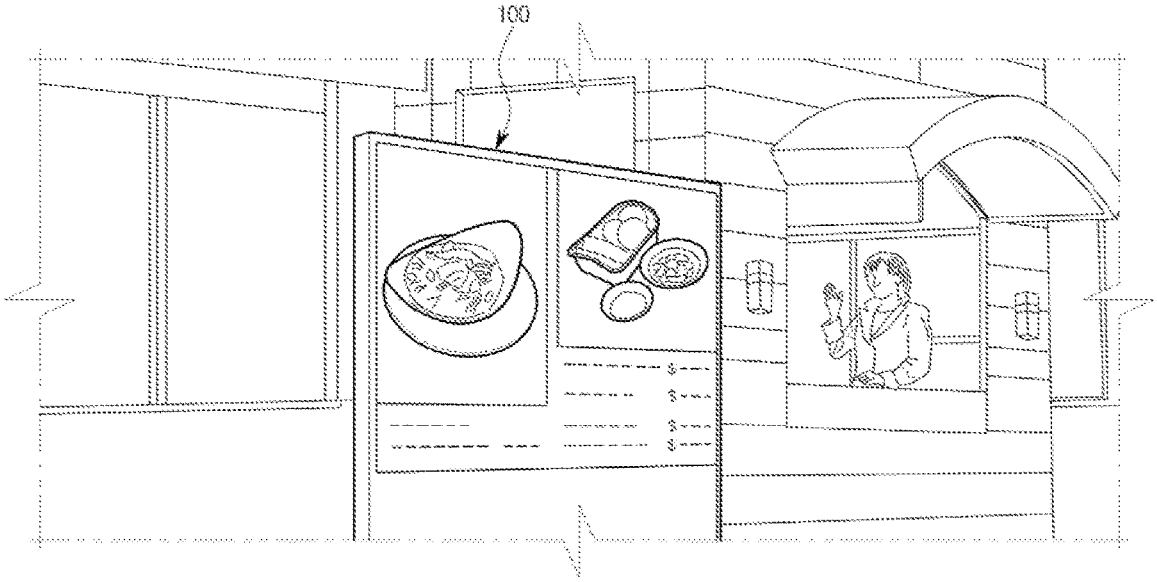
FIG. 1 is a view schematically showing a state in which a display apparatus according to an embodiment is installed outdoors.

In the following description, like reference numerals refer to like elements throughout the specification. This specification does not describe all elements of the embodiments, and in the technical field to which the present invention pertains, there is no overlap between the general contents or the embodiments.

Terms such as "unit," "module," "member," and "block" may be embodied as hardware or software. According to embodiments, a plurality of "units," "modules," "members," or "blocks" may be implemented as a single component or a single "unit," "module," "member," or "block" may include a plurality of components.

In all specifications, it will be understood that when an element is referred to as being "connected" to another element, it can be directly or indirectly connected to the other element, wherein the indirect connection includes "connection via a wireless communication network."

Also, when a part "includes" or "comprises" an element, unless there is a particular description contrary thereto, the part may further include other elements, not excluding the other elements.

Throughout the specification, when one member is positioned "on" another member, this includes not only the case where one member abuts another member, but also the case where another member exists between the two members.

The terms first, second, etc. are used to distinguish one component from another component, and the component is not limited by the terms described above.

An expression used in the singular form encompasses the expression of the plural form, unless it has a clearly different meaning in the context.

The reference numerals used in operations are used for descriptive convenience and are not intended to describe the order of operations and the operations may be performed in an order different unless otherwise stated.

Hereinafter, embodiments of the present disclosure will be described with reference to the accompanying drawings.

Embodiments of the disclosure relate to a display apparatus and a control method thereof. To be specific, a display apparatus including a plurality of display modules includes: a receiver configured to receive image data; a controller configured to calculate a local dimming value based on the received image data, and extract the image data corresponding to the display module from the image data to which the local dimming value is applied; and an output configured to output the extracted image data to be displayed.

Hereinafter, a configuration of a display apparatus according to an embodiment and a display system including the same will be described for ease of understanding, and an operation principle of the display apparatus and a control method according to the disclosure will be described.

FIG. 1 is a view schematically showing a state in which a display apparatus according to an embodiment is installed outdoors.

Referring to FIG. 1, the display apparatus according to an embodiment may be used as a large billboard installed outdoors, such as a roof of a building or a bus stop, or may be used on a large screen of a movie theater. Here, the outdoors is not limited to the outdoors, but may be a concept including a place where a large number of people come and go even if it is indoors, such as a subway station, a shopping mall, a movie theater, a company, a shop, and the like.

The display apparatus may be embodied as an LED display apparatus 100. Hereinafter, an embodiment of the present disclosure will be described using the LED display apparatus 100 as an example.

The LED display apparatus 100 may be implemented by arranging LEDs emitting red, green, and blue LEDs in a matrix form.

The LED display apparatus 100 may be implemented by packaging a red LED, a green LED, and a blue LED as one pixel and arranging them in a matrix form. The red LED, the green LED, and the blue LED implemented as one pixel may be referred to as a sub-pixel. According to an embodiment, the LED display apparatus 100 may be implemented as an LED emitting a white color and a color filter filtering it in various colors.

The LED display apparatus 100 may implement a screen using a plurality of LEDs. The LED display apparatus 100 can display content by driving the plurality of LEDs.

The LED display apparatus 100 can provide a user with good visibility due to high brightness (for example, 2,500 nit). In addition, the LED display apparatus 100 may have a waterproof and/or dustproof function. The waterproof and/or dustproof function supported by the LED display apparatus 100 may be determined by referring to the waterproof Ingress Protection rating.

Considering the information provided (e.g., advertisements) and the user's distance and/or the user's eye height, the LED display apparatus 100 may be fixed to a wall by a wall mount unit (not shown) or supported by a stand (not shown). In addition, the LED display apparatus 100 may be fixed to a groove bottom of the wall.

Hereinafter, a display system including the LED display apparatus 100 will be described to facilitate understanding.

Figure 2:
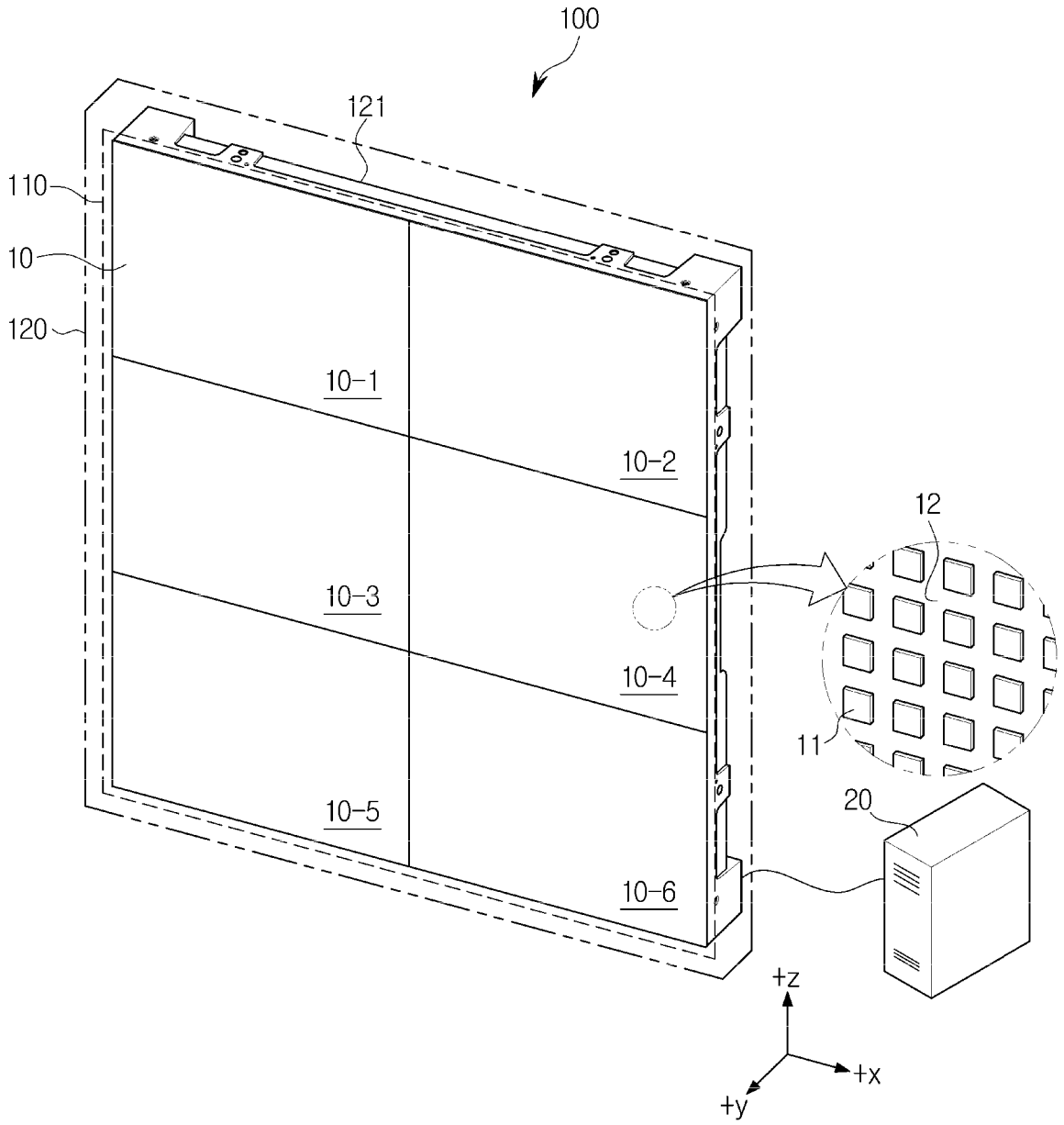
FIG. 2 is a schematic front perspective view showing an LED display apparatus according to an embodiment.
Figure 3:
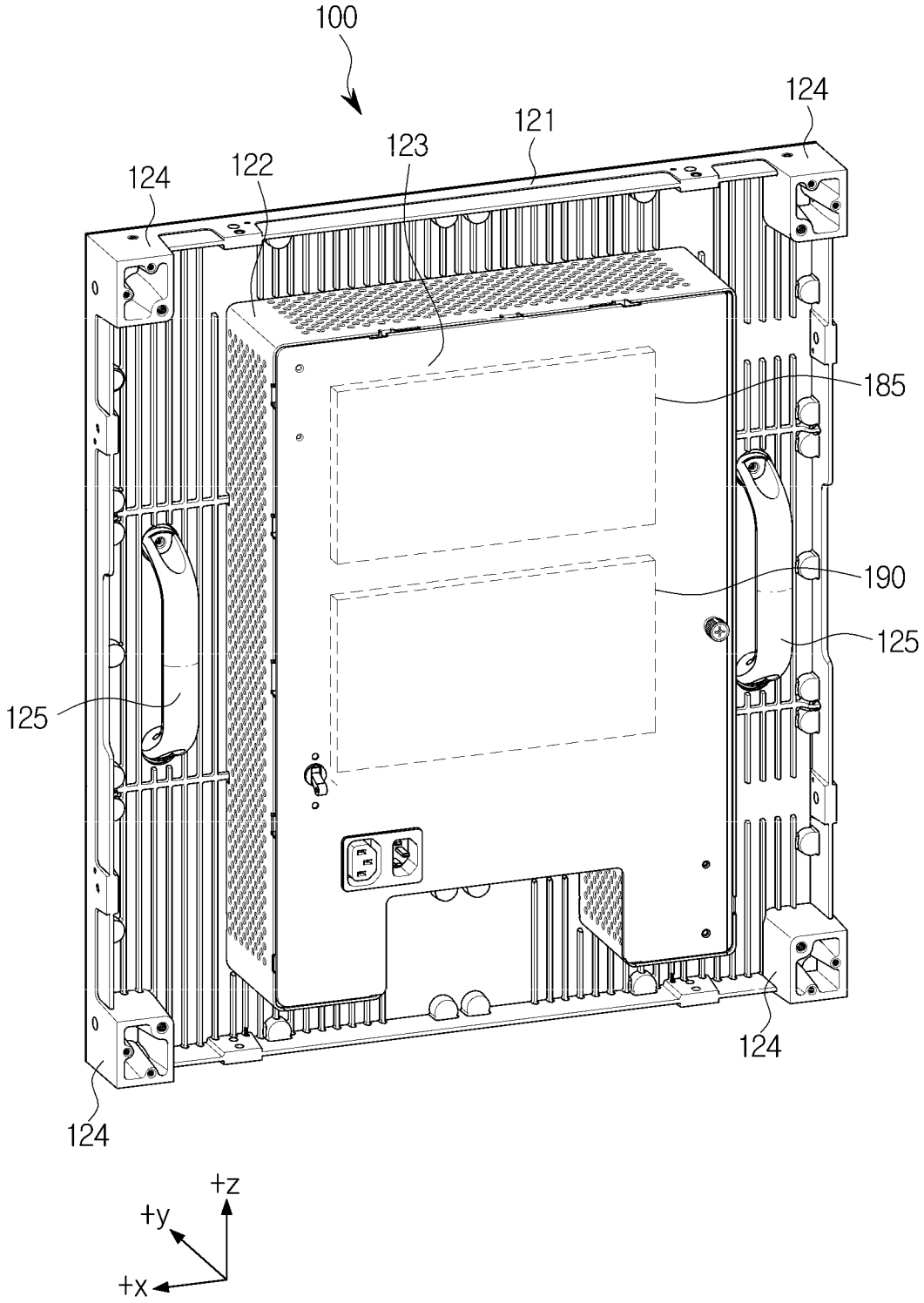
FIG. 3 is a schematic rear perspective view showing an LED display apparatus according to an embodiment.

FIG. 2 is a schematic front perspective view showing an LED display apparatus according to an embodiment. FIG. 3 is a schematic rear perspective view showing an LED display apparatus according to an embodiment.

Referring to FIG. 2, the display system according to an embodiment may include the LED display apparatus 100 that visually displays an image, and a source apparatus that provides image data to the display apparatus.

First, a source device 20 may include a memory capable of storing content including video, or may receive content from an external content source (e.g., a video streaming service server). For example, the source device 20 may store a file of content data in a memory or receive content data from an external content source.

The source device 20 may decode the stored or received content data into image frame data. For example, content data may be compressed by various video compression standards such as Moving Picture Experts Group (MPEG) and High Efficiency Video Coding (HEVC). The source device 20 may restore image frame data representing each image frame from the compressed content data, and transmit the restored image frame data to the LED display apparatus 100.

The source device 20 may be connected to one side of the LED display apparatus 100 (or one side of a LED cabinet 120) by a wired cable. In addition, the LED display apparatus 100 may be connected to the external source device 20 through wireless communication through a communicator.

When the LED display apparatus 100 is connected to the source device 20 by the wired cable and is fixed to the wall by the wall mount unit, the source device 20 may be located between the back of the LED display apparatus 100 and the wall.

The LED display apparatus 100 displays image data based on an input image transmitted from the source device 20.

The LED display apparatus 100 may be implemented by a curved LED display apparatus having a fixed (or single) curvature (e.g., 2500R) screen, a curved LED display apparatus having a screen having a plurality of curvatures (for example, a first curvature of 2500R and a second curvature of 3000R successive to the first curvature), or a curvature variable LED display apparatus capable of changing a curvature of a current screen to a screen of a different curvature by the received user input.

Referring to FIGS. 2 and 3, the LED display apparatus 100 according to an embodiment may include a plurality of LEDs 11, an LED module 10 including a circuit board 12 in which the plurality of LEDs 11 are mounted in a matrix form, an LED panel 110 including a plurality of the LED modules 10 in single or matrix form, and the LED cabinet 120 supporting one or more of the LED panels 110.

The plurality of LEDs 11 implements one pixel with the red LEDs, the green LEDs, and the blue LEDs as sub-pixels, and may be repeatedly arranged. For example, the red LED (not shown) implemented as a sub-pixel may be arranged in the same line in the direction of gravity (e.g., −z axis direction). The green LED (not shown) may be arranged on the right side of the red LED (not shown) in the same line in the direction of gravity. In addition, the blue LED may be arranged in the same line in the direction of gravity on the right side of the green LED (not shown).

The plurality of LEDs 11 may be mounted on the circuit board 12 in a matrix form (e.g., M×N, where M and N are natural numbers). The matrix may be the same array (e.g., M=N, where M and N are natural numbers, 16×16 array, 24×24 array, etc.), or a different array (e.g., M≠N, where M and N are natural numbers).

The shape of the circuit board 12 may be triangular, square, polygonal or circular (including elliptical). Corresponding to the shape of the circuit board 12, the shape of the LED module 10 may also be triangular, square, polygonal or circular (including elliptical).

The resolution (or arrangement) of the LED display apparatus 100 may vary according to the pitch between the LEDs 11 of the LED module 10 having the same size. For example, when the spacing between the plurality of LEDs 11 is 2.5 mm, the arrangement of the LED modules 10 having a resolution of 16:9 full high density (FHD) may be in a 10×5 arrangement. In addition, when the distance between the plurality of LEDs 11 is 2.0 mm, the arrangement of the LED modules 10 having a full high density (FHD) resolution may be in an 8×4 arrangement.

In addition to the FHD described above, in quad high density (QHD) or ultra-high density (UHD), the resolution (or arrangement) of the LED display apparatus 100 may vary according to the pitch between the LEDs 11 of the LED module 10 having the same size, and this will be readily understood by those skilled in the art.

The plurality of LEDs 11 are driven (for example, on, off, flickering, etc.) by driving signals transmitted from a timing controller, which will be described later. The LED display apparatus 100 may output an image corresponding to content by driving the plurality of LEDs 11.

The LED panel 110 is a set (10-1 to 10-6) of the LED modules 10 arranged in a matrix form. The LED panel 110 is a set of a plurality of the LED modules 10-1 to 10-6 arranged in the form of one LED module (one of 10-1 to 10-6) or a matrix (M×N, where M and N are natural numbers) In FIG. 2, although the LED panel 110 is composed of the plurality of LED modules in a 2×3 arrangement as an example, the number and arrangement patterns of the LED modules in the form of metrics may be variously modified. Hereinafter, an embodiment of the present invention will be described by taking the case where the LED panel 110 is composed of the first to sixth LED modules 10-1 to 10-6 in a 2×3 arrangement.

The rear surface of the LED panel (e.g., the direction opposite to light irradiation of the LED) may be supported by a front bracket 121 of the LED cabinet 120. The front bracket 121 may be referred to as an assembly bracket.

The rear surface of the LED panel may be attached or detached by a magnetic force to the front bracket 121 of the LED cabinet 120. In addition, a fastening member positioned on the rear surface of the LED panel (or the LED module) may be magnetized by an external magnetic force to be attached to or detached from the front bracket 121.

The LED cabinet 120 may include the front bracket 121, a frame bracket 122, and a cover 123. The LED cabinet 120 may include a link portion 124. Also, the LED cabinet 120 may further include one or more handles 125.

Figure 4:
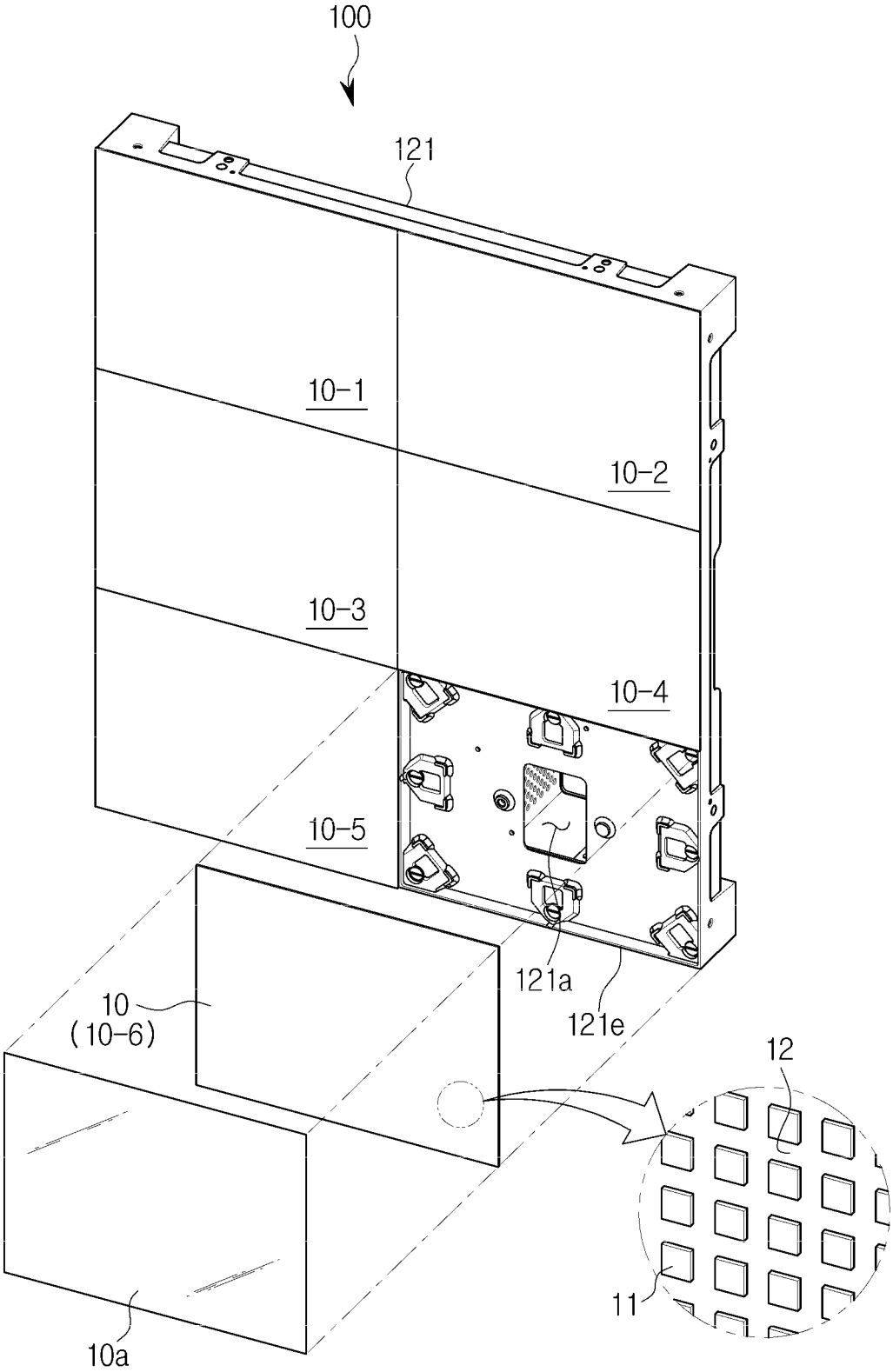
FIG. 4 is a schematic exploded perspective view showing an LED display apparatus according to an embodiment.

The front bracket 121 supports the LED panel (or the LED module) and may have an opening 121*a* (see FIG. 4). The material of the front bracket 121 includes aluminum or an aluminum alloy. The material of the front bracket 121 may include a paramagnetic metal (or alloy). In addition, the material of the front bracket 121 may include a non-magnetic metal (or alloy).

A driving signal and/or power may be transmitted to the LED module (or the LED panel) through the opening 121*a*. The area of the assembly bracket (or base plate, 121) may be greater than or equal to the area of the plurality of LED modules 10. In addition, according to the attachment or detachment structure of the front bracket 121 and the LED module 10, the area of the front bracket 121 may be smaller than the area of the plurality of LED modules 10.

When the LED display apparatus 100 is implemented as the one LED panel 110, the area of the front bracket 121 may be larger than or equal to the area of the one LED panel 110. In addition, according to the attachment or detachment structure of the front bracket 121 and the LED module 10, the area of the front bracket 121 may be smaller than the area of the LED module 10.

The frame bracket 122 may accommodate some of the components of the LED display apparatus 100 on the rear surface of the front bracket 121 (e.g., −y axis direction). For example, the frame bracket 122 may accommodate one of a timing controller 185 providing a driving signal for controlling the LED 11 and a power supplier 190 for supplying power to the LED panel 110, or alternatively, both the timing controller 185 and the power supplier 190. In addition, the frame bracket 122 may further accommodate a main board (not shown) that controls the timing controller 185 and the power supplier 190.

The timing controller 185 may transmit a control signal for driving the LED to each of the LEDs 11 according to a video (or image) received from the control device 100. The timing controller 185 may be connected to an external control device (not shown) and a cable (not shown) through an opening (not shown) of the frame bracket 122.

The cover 123 may open and close the rear surface of the frame bracket 122.

The link portion 124 may connect the LED cabinet to other LED cabinets (for example, bolts or rivets) located on one side (for example, upper, lower, left, and right) of the corresponding LED cabinet.

The handle 125 may be used to move or attach/mount the LED cabinet 120.

The LED display apparatus 100 may include a plurality of the LED panels 110 arranged in a matrix form and a plurality of the LED cabinets 120 corresponding to the plurality of LED panels 110. In addition, the LED display apparatus 100 may include one of the LED panels 110 and one of the LED cabinets 120.

FIG. 4 is a schematic exploded perspective view and a schematic enlarged view showing the LED display apparatus 100 according to an embodiment of the present disclosure.

Referring to FIG. 4, an optical member 10*a* may be attached to the LED module 10 including the LED 11 and the circuit board 12.

The optical member 10*a* may uniformly maintain or change (e.g., by refraction or reflection) the direction of travel of light emitted from the LED 11. The optical member 10*a* may be, for example, an optical film or an optical lens film.

The material of the optical member may include acrylic, polyethylene terephthalate (PET), resin, silicon, or a material having high transmittance and transparency.

The fill factor may be improved by a cross-sectional shape of the optical member 10*a* (e.g., a round shape, a triangular shape, and/or a triangular shape with a rounded vertex). When the fill factor is improved, the amount of light may be provided in a light distribution lowering region generated by a gap between the plurality of LEDs 11. The occurrence of blur or moire may be limited by the amount of light provided.

Luminance representing brightness per unit area of the LED 11 may be increased by the optical member 10*a*. When comparing the LED module 10 without the optical member 10*a* and the LED module 10 with the optical member 10*a* attached, the luminance increased by the optical member may be 8% or more and 30% or less.

By the optical member 10*a*, the contrast ratio indicating the difference between the lightest and darkest parts in the LED module 10 can be improved. The contrast ratio improved by the optical member 10*a* may be 7,500:1 or more and 8,500:1 or less.

The optical member 10*a* may be positioned to contact the LED 11 of the LED module 10. The optical member 10*a* may be positioned to be in contact with the LED 11 of the LED module 10 by adhesion (e.g., adhesive, etc.).

The structure of the LED display apparatus 100 according to an embodiment has been described above. Hereinafter, an operation principle of the LED display apparatus 100 according to an embodiment will be described.

Figure 5:
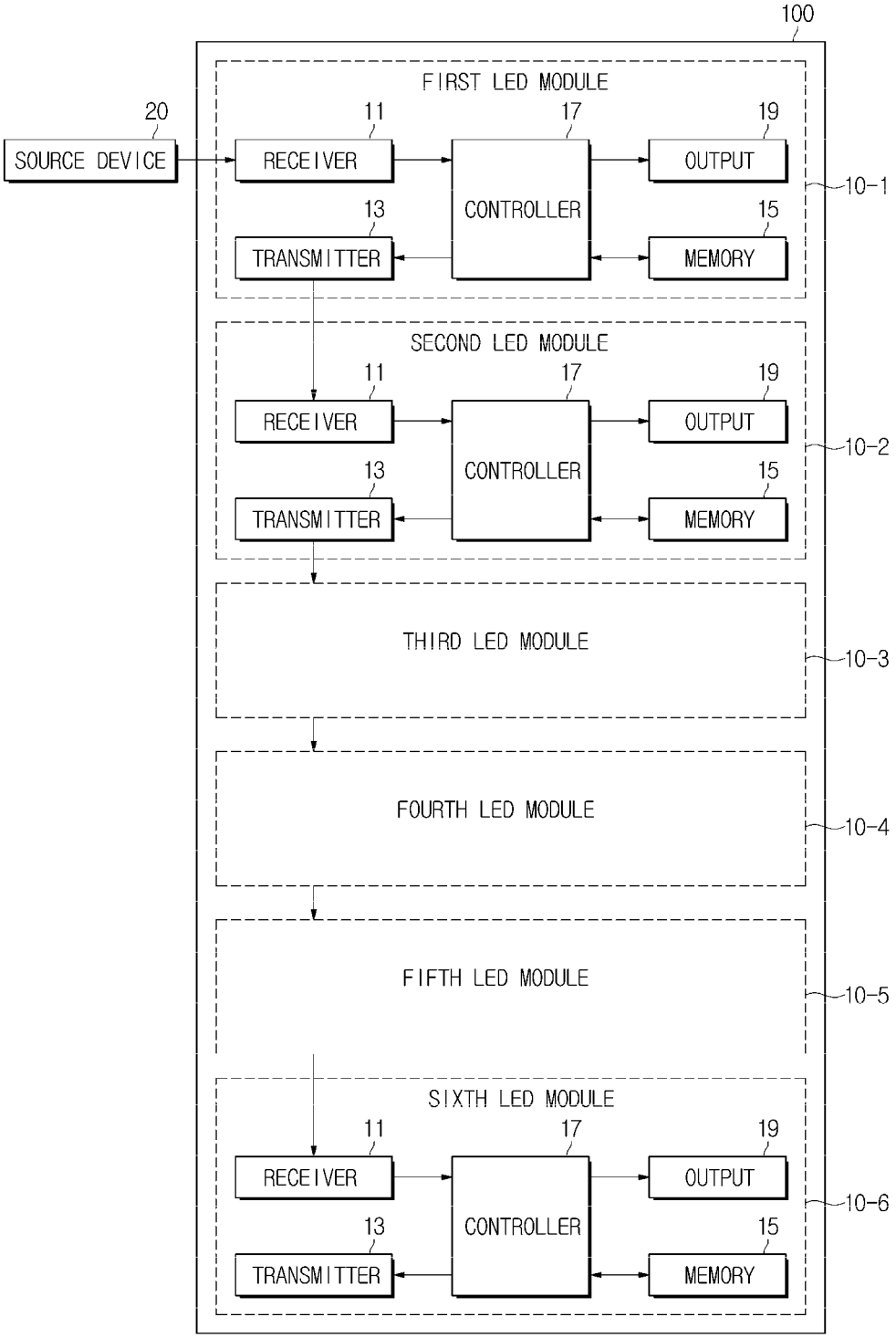
FIG. 5 is a control block diagram of an LED display apparatus according to an embodiment.

FIG. 5 is a control block diagram of an LED display apparatus 100 according to an embodiment.

Referring to FIG. 5, the LED display apparatus 100 according to an embodiment includes the first LED module 10-1, the second LED module 10-2, and an nth LED module **10-*n* (here, n is an integer of 3 or more). Hereinafter, for convenience of description, an embodiment will be described on the premise of the LED display apparatus 100 including six LED modules, that is, the first to sixth LED modules 10-1 to 10-6, as illustrated in FIG. 3**.

The first to fifth LED modules 10-1 to 10-5 include a receiver 11, a transmitter 13, a memory 15, a controller 17, and an output 19, respectively, for receiving image data. The sixth LED module 10-6 may not include the transmitter 13 because it receives image data last. In addition, it is preferable to include the transmitter 13 in order to transmit the received image data to another LED module when the LED cabinet is arranged or according to the layout change of the LED module.

Looking at the function of each component in detail, first, the receiver 11 is provided to receive image data. More specifically, the receiver 11 of the first LED module 10-1 may receive image data from the source device 20, and the receiver 11 of the second to sixth LED modules 10-2 to 10-6 may receive image data from the transmitters 13 of the first to sixth LED modules 10-1 to 10-6, respectively. Each of the LED modules transmits the image data received from the receiver 11 to the controller 17.

The transmitter 13 transmits the same image data received from the receiver 11 to the controller connected to the corresponding LED module under the control of the controller 17. The receiver 11 of the other LED module adjacent to the transmitter 13 of the LED module can exchange data by wireless or wired communication.

For example, the transmitter 13 of the first LED module 10-1 transmits the same video data as the video data received by the receiver 11 through the receiver 11 of the second LED module 10-2 connected to the first LED module 10-1 to the second LED module 10-2. In the same way, the transmitters 13 of the second to fifth LED modules 10-2 to 10-5 transmit the same image data as the image data received from the receiver 11 of each of the LED modules through the receiver 11 of the third to sixth LED modules 10-3 to 10-6 connected to the second to fifth LED modules 10-2 to 10-5 to the second to fifth LED modules 10-2 to 10-5.

The disclosed embodiment is to provide a screen to which local dimming values are applied to the LED display apparatus 100 after receiving the entirety of image data for the content from the source device 20 and dimming the image data based on the entirety of image data. Therefore, each of the LED modules may receive the entirety of image data for the content by looping out the image data received by the adjacent LED module connected to the corresponding LED module. Hereinafter, a method of transmitting the received image data to another adjacent LED module without a separate process is defined as a loop out method.

The memory 15 may store programs and data for controlling the operation of the LED display apparatus 100, and may temporarily store data generated while controlling the operation of the LED display apparatus 100.

The memory 15 calculates a local dimming value based on the image data received from the receiver 11, and stores program and device setting information for extracting and dividing the image data corresponding to the LED module from the image data to which the local dimming value is applied. Specifically, the memory 15 may store a program for calculating a luminance average value for each block of the received image data, determining a dimming area based on the luminance average value, and calculating the local dimming value.

The memory 15 may include a non-volatile memory such as Read Only Memory (ROM), Flash Memory, Erasable Programmable Read Only Memory (EPROM), and Electrically Erasable Programmable Read Only Memory (EEPROM) for storing data for a long period of time, and a volatile memory such as static random access memory (S-RAM) and dynamic random access memory (D-RAM) for temporarily storing data.

The controller 17 controls the overall operation of the LED display apparatus 100 and signal flow between the internal components of the LED display apparatus 100 and functions to process data.

The controller 17 may execute a control program or application stored in the memory 15 of the LED module when a control command is input from the user or a preset condition is satisfied.

When the controller 17 receives the image data from the receiver 11 of the LED module, the controller 17 controls the transmitter to transmit the same image data as the received image data to another LED module connected to the LED module.

For example, when the LED module includes the first LED module 10-1 to the sixth LED module 10-6, the first LED module 10-1 loops out the image data received through the receiver 11 of the first LED module 10-1 through the transmitter 13 of the first LED module 10-1 to the second LED module 10-2. In the same way, the second to fifth LED modules 10-2 to 10-5 may transmit the image data received through the receiver 11 of the second to fifth LED modules 10-2 to 10-5 each through the transmitter 13 of the third to sixth LED modules 10-3 to 10-6 to the third to sixth LED modules 10-3 to 10-6. The LED display apparatus 100 according to the disclosed embodiment may provide image data to each of the LED modules constituting the LED display apparatus 100 in the above manner. Meanwhile, the method of providing image data to the LED module is not limited thereto, and the source device 20 may simultaneously transmit the entirety of image data to the first to sixth LED modules 10-1 to 10-6.

The controller 17 determines the dimming area of the image data based on the image data received from the receiver 11, and calculates a local dimming value for the dimming area. Hereinafter, an area in which dimming processing is performed among the image data received from the LED module is defined as the dimming area.

The controller 17 may determine a dimming area by calculating a luminance average value for each block of image data for all image data received from the receiver 11. The controller 17 may determine a portion having a luminance value that differs by a predetermined value or more from the average luminance value of each block of the received image data as the dimming area.

When the dimming area is determined, the controller 17 calculates a local dimming value to output the brightness of a dimming area having a luminance value higher than a preset reference value more brightly than the luminance average value, and calculates the local dimming value to output the brightness of a dimming area having a luminance value below a preset reference value less brightly than the luminance average value. However, the above-described method shows an example of a method for calculating a local dimming value, and the method for calculating a local dimming value is not limited thereto.

The controller 17 then applies a local dimming value to the dimming area of the entirety of image data, and extracts and splits the image data corresponding to the LED module from the image data to which the local dimming value is applied.

As described above, the program and device setting information for extracting and dividing the image data corresponding to the LED module from the image data to which the local dimming value is applied may be stored in the memory 15 of the LED module. Accordingly, the controller 17 may extract and split the image data corresponding to the corresponding LED module based on the device setting information stored in the memory 15.

For example, the first LED module 10-1 may extract and split the image data corresponding to the first LED module 10-1 from the entirety of image data to which the local dimming value is applied. In the same way, the second to sixth LED modules 10-2 to 10-6 may extract and split the image data corresponding to the second to sixth LED modules 10-2 to 10-6, respectively.

After calculating the local dimming value based on the entirety of image data and applying it to the received image data, it is possible to extract and segment the image data corresponding to the LED module by reflecting the device setting information for each of the LED modules.

The controller 17 may control the output 19 so that the extracted and segmented image data is output when the image data corresponding to the LED module is extracted and divided.

The output 19 may include a plurality of LEDs mounted on the circuit boards of each of the LED modules. The output 19 outputs the image data corresponding to the corresponding LED module among the image data received from the receiver 11 of the LED module under the control of the controller 17. Meanwhile, the type of the output 19 is not limited to the plurality of LEDs, and may be provided with various elements according to the type of display apparatus. For example, the output unit may be a concept including various elements that can be output to display image data extracted from a display apparatus, such as a liquid crystal display (LCD) and an organic light emitting diode (OLED) in addition to a plurality of LEDs.

The LED display apparatus 100 according to the disclosed embodiment may apply the above method to output the image data corresponding to each of the LED modules in each of the LED modules, so that a local dimming function can be implemented in the LED display apparatus 100 composed of the plurality of LED modules. In this way, even when outputting multiple screens through the plurality of LED modules, it is possible to output the screen naturally as if viewing one screen, and to provide a smoother screen to the user.

The operation principle of the LED display apparatus 100 according to an embodiment has been described above. Next, a description will be given of a control process of the LED display apparatus 100 according to an embodiment.

The control process of the LED display apparatus 100 according to the disclosed embodiment aims to output a smoother screen by dimming the received image data in the LED display apparatus 100 provided to display one image with the plurality of LED modules.

To this end, each of the LED modules receives the entirety of image data through the receiver 11 of each of the LED modules, and then applies local dimming values to output the image data corresponding to the corresponding LED module. Hereinafter, for convenience of description, a control method of a display apparatus will be described with reference to a process of calculating a local dimming value performed in one LED module of the LED display apparatus 100.

Figure 6:
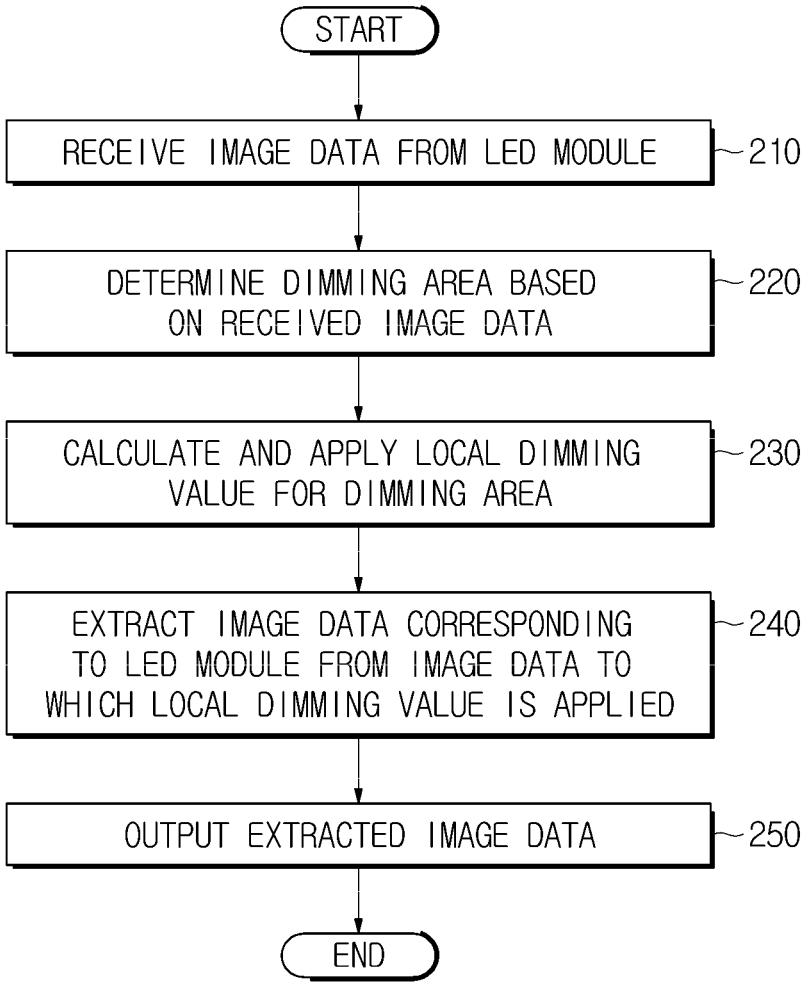
FIG. 6 is a control flowchart of an LED display apparatus according to an embodiment.
Figure 7:
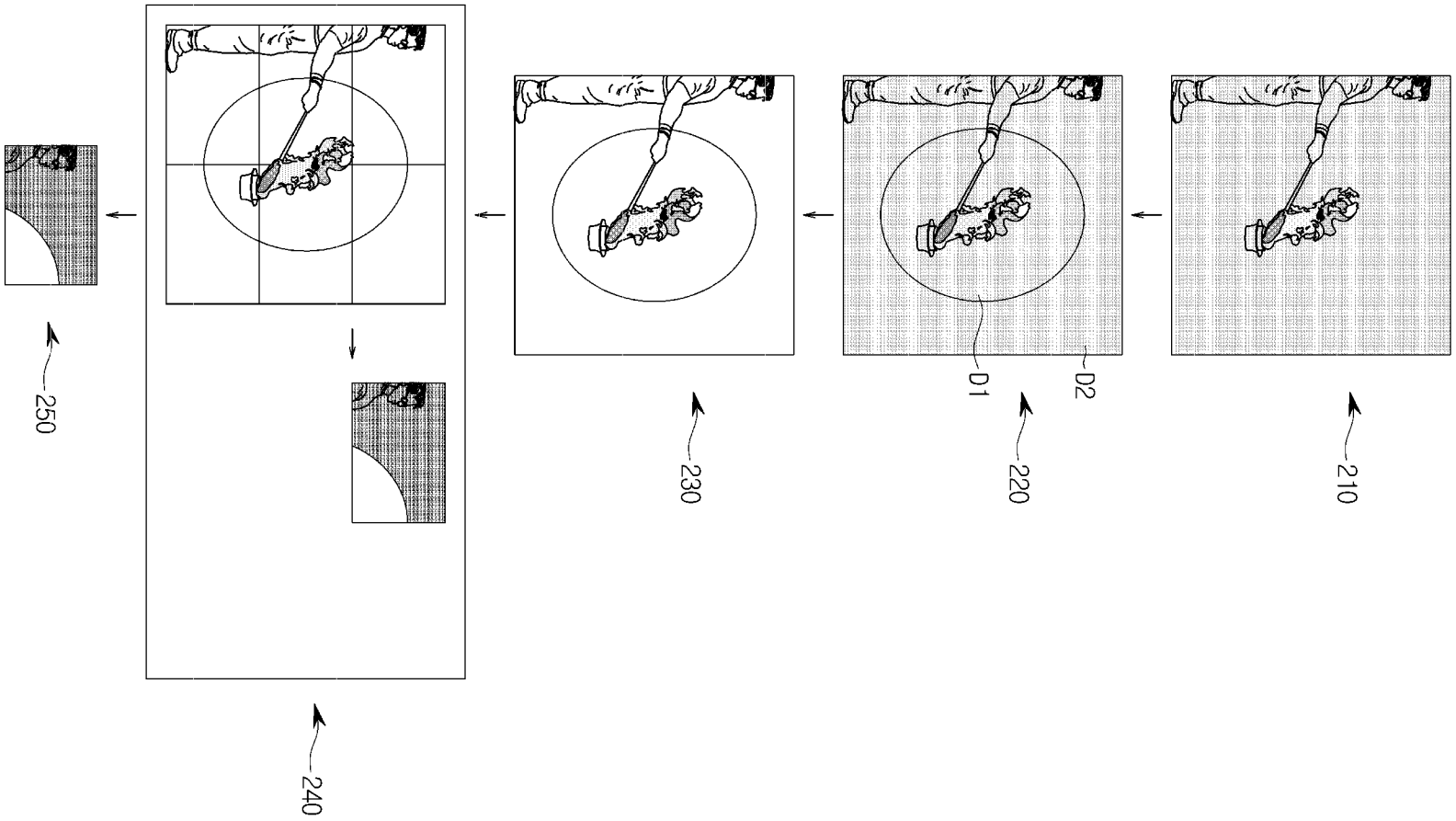
FIG. 7 is a view for explaining the process of FIG. 6.

FIG. 6 is a control flowchart of the LED display apparatus 100 according to an embodiment, and FIG. 7 is a view for explaining the process of FIG. 6.

Referring to FIGS. 6 and 7, the control method of the display apparatus according to an embodiment includes receiving image data from the LED module (210), determining a dimming area based on the received image data (220), calculating and applying a local dimming value for the dimming area (230), extracting the image data corresponding to the LED module from the image data to which the local dimming value is applied (240), and outputting the extracted image data (250).

First, a process of receiving image data from the receiver 11 of the LED module is performed. For example, the first LED module 10-1 receives image data from the source device 20 and delivers the received image data to the controller 17 of the LED module.

When the controller 17 receives the image data, a process of determining a dimming area based on the received image data is performed. Determining the dimming area based on the received image data may include calculating a luminance average value for each block of the received image data and determining a portion having a luminance value that differs from a luminance value by a predetermined value or more as the dimming area.

For example, as shown in FIG. 7, the controller 17 may determine a first dimming area and a second dimming area based on the entirety of image data. Hereinafter, the first dimming area is an area having a luminance value higher than a predetermined value than a luminance average value for each block of all image data, and the second dimming area is defined as an area having a luminance value lower than a predetermined value than a luminance average value for each block of all image data. FIG. 7 illustrates an example in which the entirety of image data is divided into the first dimming area and the second dimming area, but some areas of the entirety of image data are determined as dimming areas, and the other areas may not perform dimming processing.

When the controller 17 determines the dimming area, a process of calculating a local dimming value for the dimming area is performed. Calculating the local dimming value for the dimming area may include calculating the local dimming value to output the brightness of a dimming area having a luminance value higher than a predetermined value more than the average luminance value, and calculating a local dimming value to output the brightness of a dimming area having a luminance value less than or equal to a predetermined value lower than the average luminance value.

For example, the controller 17 calculates the local dimming value to output the brightness of the first dimming area having a luminance value greater than or equal to a luminance average value more brightly than the luminance average value as shown in FIG. 7, and the local dimming value may be calculated to output the brightness of the second dimming area having a luminance value less than or equal to a predetermined value less brightly than the average luminance value.

This method shows an example of a method for calculating a local dimming value, and the method for calculating a local dimming value is not limited to the above-described method.

When the local dimming value is calculated by the controller 17, applying a local dimming value to the dimming area of the entirety of image data, and extracting and dividing the image data corresponding to the LED module from the image data to which the local dimming value is applied are performed. The controller 17 may extract and split the image data corresponding to the corresponding LED module based on the device setting information stored in the memory 15.

For example, the controller 17 may extract and split the image data corresponding to the first LED module 10-1 from the image data to which the local dimming value is applied. Referring to FIG. 7, the image data corresponding to the first LED module 10-1 may include a part of the first dimming area and a part of the second dimming area. In the same manner, the controller 17 of the second to sixth LED modules 10-2 to 10-6 may extract and split the image data corresponding to each of the LED modules.

The controller 17 may control the output 19 to output the image data corresponding to the LED module after completion of the extraction and segmentation process of the image data.

For example, the controller 17 of the first LED module 10-1 may control the output 19 so that the image data corresponding to the first LED module 10-1 is displayed. In the same way, the controller 17 of the second to sixth LED modules 10-2 to 10-6 may control the output 19 so that the image data corresponding to the second to sixth LED modules 10-2 to 10-6 are respectively displayed.

The control process of the LED display apparatus 100 according to an embodiment has been described above.

The display apparatus according to the disclosed invention may be provided in a manner that the first to sixth LED modules 10-1 to 10-6 are mounted in one LED cabinet as described above. According to an embodiment, a plurality of LED cabinets may be combined to provide a large display screen.

In the case of the LED display apparatus 100 mounted in the plurality of LED cabinets, it is also possible to perform dimming processing on image data with the same principle as described above. Hereinafter, a case in which the LED display apparatus 100 is provided by combining the plurality of cabinets will be described.

Figure 8:
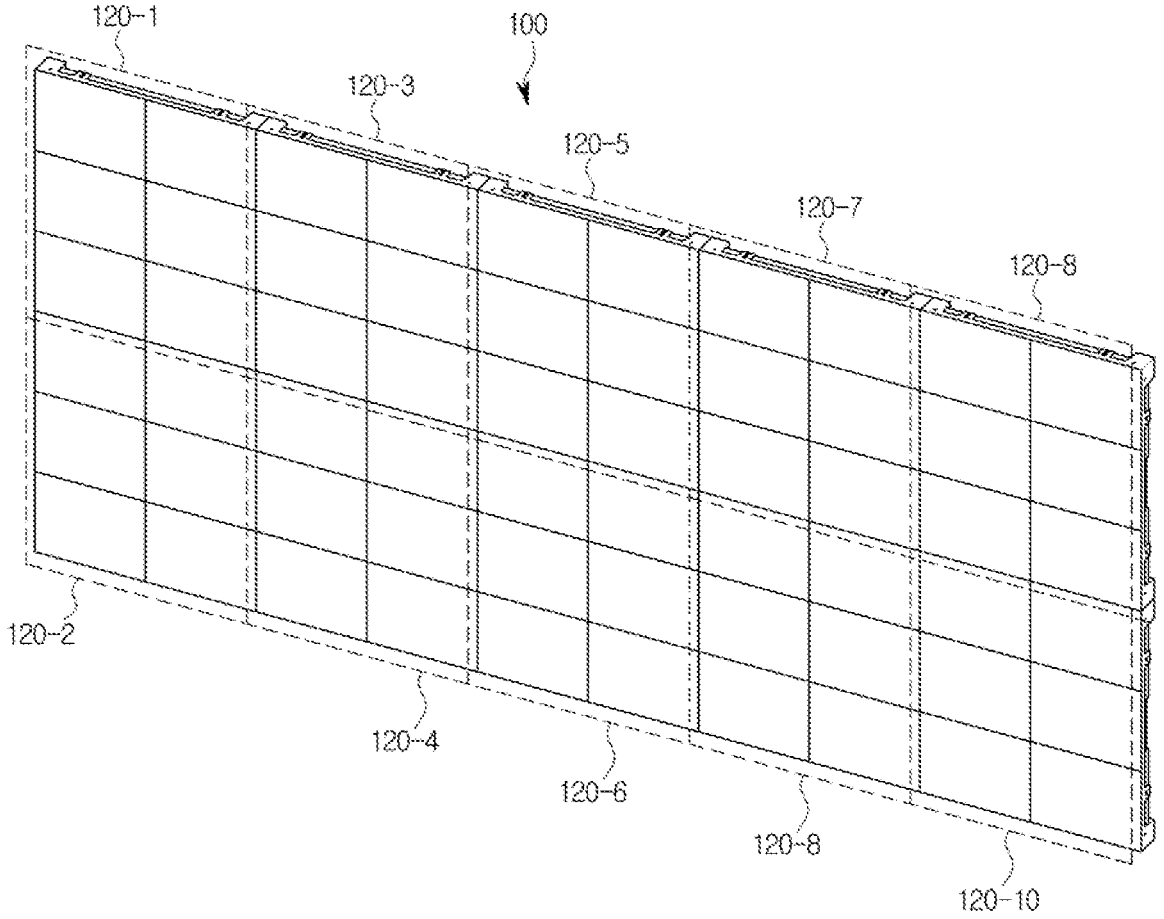
FIG. 8 is a perspective view schematically showing an LED display apparatus in which a plurality of LED cabinets are combined.

FIG. 8 is a perspective view schematically showing the LED display apparatus 100 in which a plurality of LED cabinets are combined.

Referring to FIG. 8, the LED display apparatus 100 may be configured by combining a plurality of LED cabinets 120-1 to 120-10.

The plurality of LED cabinets 120 may be connected in a matrix form (e.g., S×T, where S and T are natural numbers). The matrix is the identical array (e.g., S=T, where S and T are natural numbers, 2×2 array, 3×3 array, etc.), or a another array (e.g., S≠T, where S and T are natural numbers). The plurality of LED cabinets 120-1 to 120-10 may be interconnected by the link portion 124 and a fastening member (e.g., a bolt or rivet).

Each timing controller (not shown) of the plurality of LED cabinets 120-1 to 120-10 may transmit data and a control signal by generating video (or image) data and control signals corresponding to the video (or image) received from the source device 20 to each of the LEDs 11 in each of the LED panels 110.

The LED display apparatus 100 may display content (for example, a video, an image, etc.) by driving each of the LEDs 11 of the LED panel 110 of the plurality of LED cabinets 120-1 to 120-10.

The LED display apparatus 100 may provide a screen to which the above-described local dimming value is applied, and the contents overlapping with the above-described contents in relation to the process of performing the dimming process on the screen implemented in the LED display apparatus 100 will be omitted.

Figure 9:
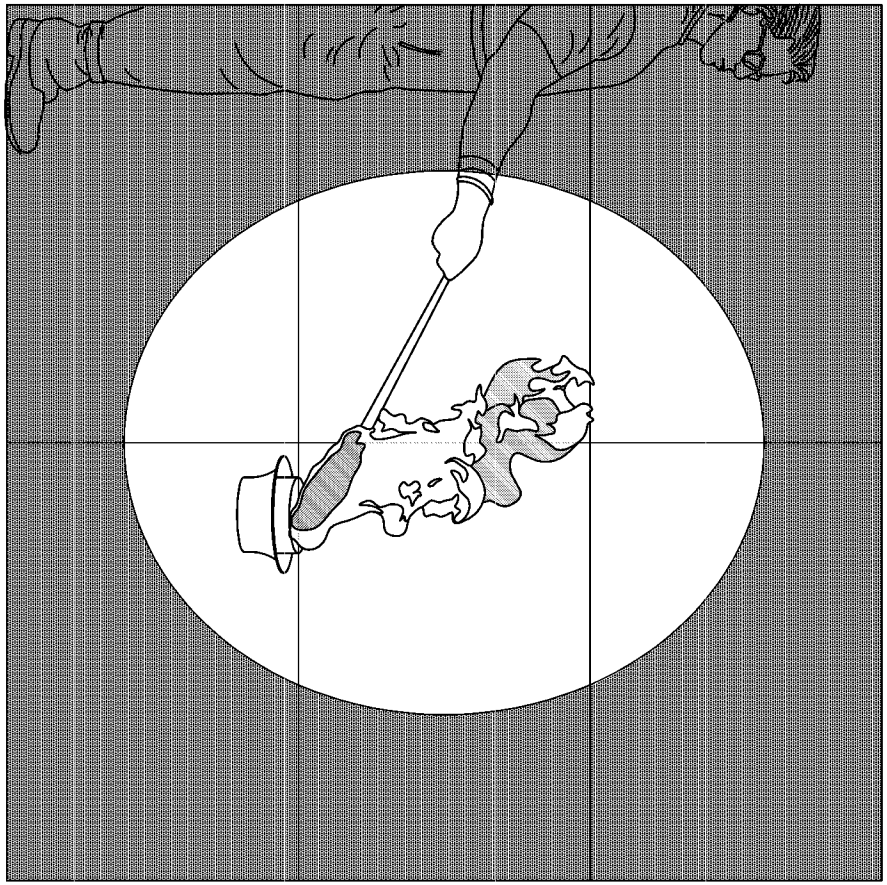
FIG. 9 is a diagram illustrating an example of a screen output from an LED display apparatus according to an embodiment.

FIG. 9 is a diagram illustrating an example of a screen output from the LED display apparatus 100 according to an embodiment.

As illustrated in FIG. 9, the LED display apparatus 100 may provide a smooth screen to the user by outputting a screen to which a local dimming value as described above is applied. In other words, since the local dimming value is determined based on the entire image before dividing the screen for configuring a video wall, the screen is divided and output, so that a smooth screen can be provided when viewed in one large screen.

The display apparatus and its control process according to an embodiment have been described above. The technical spirit of the invention is not limited by the above-described examples, and should be broadly understood as a concept including changes within a range that can be easily understood by those skilled in the art.

The invention claimed is:

1. A display apparatus comprising a plurality of display modules, each display module of the plurality of display modules comprising:

a receiver configured to receive image data;

a transmitter configured to transmit the received image data to another display module connected to the plurality of display modules;

a controller configured to calculate a local dimming value and a dimming area based on the received image data, and extract image data corresponding to the display module from the image data to which the local dimming value of the dimming area is applied; and an output configured to output the extracted image data to be displayed, wherein the controller is further configured to calculate a luminance average value for each block of the received image data, and determine the dimming area based on the luminance average value.

2. The display apparatus of claim 1, wherein the transmitter of each display module is further configured to transmit image data that is identical to the received image data to the other display module connected to the plurality of display modules.

3. The display apparatus of claim 1, wherein the controller of each display module is further configured to calculate the local dimming value so an output a brightness of the dimming area having a luminance value equal to or higher than a preset reference value is brighter than the calculated luminance average value, and calculate the local dimming value so an output a brightness of the dimming area having a luminance value below the preset reference value is less brighter than the calculated luminance average value.

4. The display apparatus of claim 1, wherein each display module of the plurality of display modules further comprises:

a memory in which device setting information for extracting the image data corresponding to the display module is stored.

5. The display apparatus of claim 1, wherein the plurality of display modules comprises:

a first LED display module configured to receive image data from a source device; and a second LED display module configured to receive image data that is the same as the image data received by the first LED display module from the first LED display module.

6. The display apparatus of claim 5, wherein the first LED display module is further configured to display image data corresponding to the first LED display module among the image data to which the local dimming value is applied, and the second LED display module is further configured to display image data corresponding to the second LED display module among the image data to which the local dimming value is applied.

7. A control method of a display apparatus including a plurality of display modules comprising:

receiving image data by a first display module;

transmitting the received image data from the first display module to another display module connected to the plurality of display modules;

calculating a luminance average value for each block of the received image data;

determining a dimming area based on the luminance average value;

calculating a local dimming value based on the received image data; and extracting and displaying image data corresponding to the first display module from the image data to which the local dimming value of the dimming area is applied.

8. The method of claim 7 further comprising:

transmitting image data that is identical to the received image data from the first display module to the other display module connected to the plurality of display modules.

9. The method of claim 7, wherein the calculating the local dimming value based on the received image data comprises:

calculating the local dimming value so an output a brightness of the dimming area having a luminance value equal to or higher than a preset reference value is brighter than the luminance average value, and calculating the local dimming value so an output a brightness of the dimming area having a luminance value below the preset reference value is less bright than the luminance average value.

10. The method of claim 7, wherein the plurality of display modules comprises:

a first LED display module configured to receive image data from a source device; and a second LED display module configured to receive image data that is the same as the image data received by the first LED display module from the first LED display module.

11. The method of claim 10, further comprising:

displaying, by the first LED display module, image data corresponding to the first LED display module among the image data to which the local dimming value is applied, and displaying, by the second LED display module, image data corresponding to the second LED display module among the image data to which the local dimming value is applied.

* * * * *